US010116039B2

(12) United States Patent
Lee et al.

(10) Patent No.: US 10,116,039 B2
(45) Date of Patent: Oct. 30, 2018

(54) ANTENNA APPARATUS AND ELECTRONIC DEVICE HAVING THE SAME

(71) Applicant: Samsung Electronics Co., Ltd., Gyeonggi-do (KR)

(72) Inventors: Jong-Hyuck Lee, Gyeonggi-do (KR); Se-Hyun Park, Gyeonggi-do (KR); Gyu-Sub Kim, Seoul (KR); Yong-Eui Hong, Seoul (KR)

(73) Assignee: Samsung Electronics Co., Ltd (KR)

( * ) Notice: Subject to any disclaimer, the term of this patent is extended or adjusted under 35 U.S.C. 154(b) by 310 days.

(21) Appl. No.: 14/830,237

(22) Filed: Aug. 19, 2015

(65) Prior Publication Data

US 2016/0056530 A1 Feb. 25, 2016

(30) Foreign Application Priority Data

Aug. 19, 2014 (KR) ..... 10-2014-0107666

(51) Int. Cl.

*H01Q 1/24* (2006.01)
*H01Q 9/04* (2006.01)
*H01Q 5/378* (2015.01)

(52) U.S. Cl.

CPC ..... *H01Q 1/243* (2013.01); *H01Q 5/378* (2015.01); *H01Q 9/0407* (2013.01)

(58) Field of Classification Search

CPC ..... H01Q 1/243; H01Q 9/0407; H01Q 5/378; H01Q 1/38

See application file for complete search history.

(56) References Cited

U.S. PATENT DOCUMENTS

2011/0012794 A1* 1/2011 Schlub ..... H01Q 1/243 343/702
2011/0050508 A1* 3/2011 Guterman ..... H01Q 1/2266 343/702
2013/0321216 A1* 12/2013 Jervis ..... G06F 1/1616 343/702
2014/0111388 A1 4/2014 Di Nallo et al.
2014/0132456 A1 5/2014 Wang et al.
2014/0240190 A1* 8/2014 Chen ..... H01Q 5/30 343/843
2014/0266922 A1* 9/2014 Jin ..... H01Q 21/28 343/702
2014/0292587 A1* 10/2014 Yarga ..... H01Q 1/243 343/702
2014/0354491 A1 12/2014 Kim et al.
2014/0375510 A1* 12/2014 Lee ..... H01Q 1/243 343/702

FOREIGN PATENT DOCUMENTS

KR 10-2011-0124131 11/2011
KR 10-2012-0117048 10/2012

* cited by examiner

*Primary Examiner* — Tho G Phan
(74) *Attorney, Agent, or Firm* — The Farrell Law Firm, P.C.

(57) ABSTRACT

An antenna apparatus and an electronic device are provided. The electronic device includes a plurality of metal parts, an antenna radiator arranged around the plurality of metal parts, and at least one sub antenna radiator arranged to electrically connect with the antenna radiator around the antenna radiator, and prevent deterioration of radiation efficiency of the antenna radiator caused by the plurality of metal parts.

15 Claims, 18 Drawing Sheets

ANTENNA APPARATUS AND ELECTRONIC DEVICE HAVING THE SAME

PRIORITY

This application claims priority under 35 U.S.C. § 119(a) to a Korean Patent Application filed in the Korean Intellectual Property Office on Aug. 19, 2014, and assigned Serial No. 10-2014-0107666, the contents of which are incorporated herein by reference.

BACKGROUND

1. Field of the Invention

The present disclosure relates to an electronic device including an antenna apparatus.

2. Description of the Related Art

The growth of electronic telecommunication technologies has led to the emergence of electronic devices having various functions. In general, these electronic devices have convergence functions for performing one or more complex functions.

Recently, manufacturing companies struggle to increase the rigidity of electronic devices, as the depth, i.e. 'slimness', of the electronic device is gradually reduced in order to satisfy consumers' interest as the gap between functionality of various electronic devices decreases, to strengthen the design aspects of the electronic devices. As part of this trend, manufacturing companies replace components of the electronic devices with metal materials to increase the rigidity of the electronic devices, which provides a concurrent benefit of increasing aesthetic appeal, while upgrading the qualities of the electronic devices. Further, the manufacturing companies struggle to solve an issue of grounding caused by the use of the metal materials and a deterioration of antenna radiation performance.

SUMMARY

The present disclosure has been made to address the above-mentioned problems and disadvantages, and to provide at least the advantages described below. Accordingly, an aspect of the disclosure provides an antenna apparatus implemented to prevent radiation performance deterioration caused by peripheral metal parts (e.g., a metal housing, a metal bezel, and an electronic component using metal materials), and an electronic device having the same.

Another aspect of the present disclosure provides an antenna apparatus which forms at least a partially visible region of an electronic device, thereby improving the appearance of the electronic device and concurrently contributing to radiation performance enhancement, and to provide an electronic device having the same.

Another aspect of the present disclosure provides an antenna apparatus configured to provide enhanced radiation performance without changing the mounting condition of the antenna apparatus, with increased volume of an antenna radiator, thereby securing a sufficient Radio Frequency (RF) bandwidth, and to provide an electronic device having the same.

In accordance with an aspect of the present disclosure, an electronic device is provided that includes a plurality of metal parts, an antenna radiator arranged around the plurality of metal parts, and at least one sub antenna radiator arranged to electrically connect with the antenna radiator, to prevent deterioration of radiation efficiency of the antenna radiator caused by the plurality of metal parts.

In accordance with an aspect of the present disclosure, an antenna apparatus is provided that includes an antenna radiator arranged around a plurality of metal parts of an electronic device, and at least one sub antenna radiator arranged around the antenna radiator to electrically couple with the antenna radiator, to prevent deterioration of radiation efficiency of the antenna radiator caused by the plurality of metal parts.

In accordance with an aspect of the present disclosure, an electronic device is also provided that includes a metal bezel accommodating at least a portion of an edge of the electronic device, an antenna radiator arranged around the metal bezel, a battery cover arranged on a rear surface of the electronic device, and at least one sub antenna radiator arranged in a region where at least a portion of the sub antenna radiator is overlapped with the antenna radiator on an inner surface of the battery cover, to prevent deterioration of radiation efficiency of the antenna radiator caused by a plurality of metal parts.

BRIEF DESCRIPTION OF THE DRAWINGS

The above and other aspects, features and advantages of the present disclosure will become more apparent from the following detailed description, taken in conjunction with the accompanying drawings, in which.

DETAILED DESCRIPTION OF THE EMBODIMENTS OF THE PRESENT INVENTION

Figure 1:
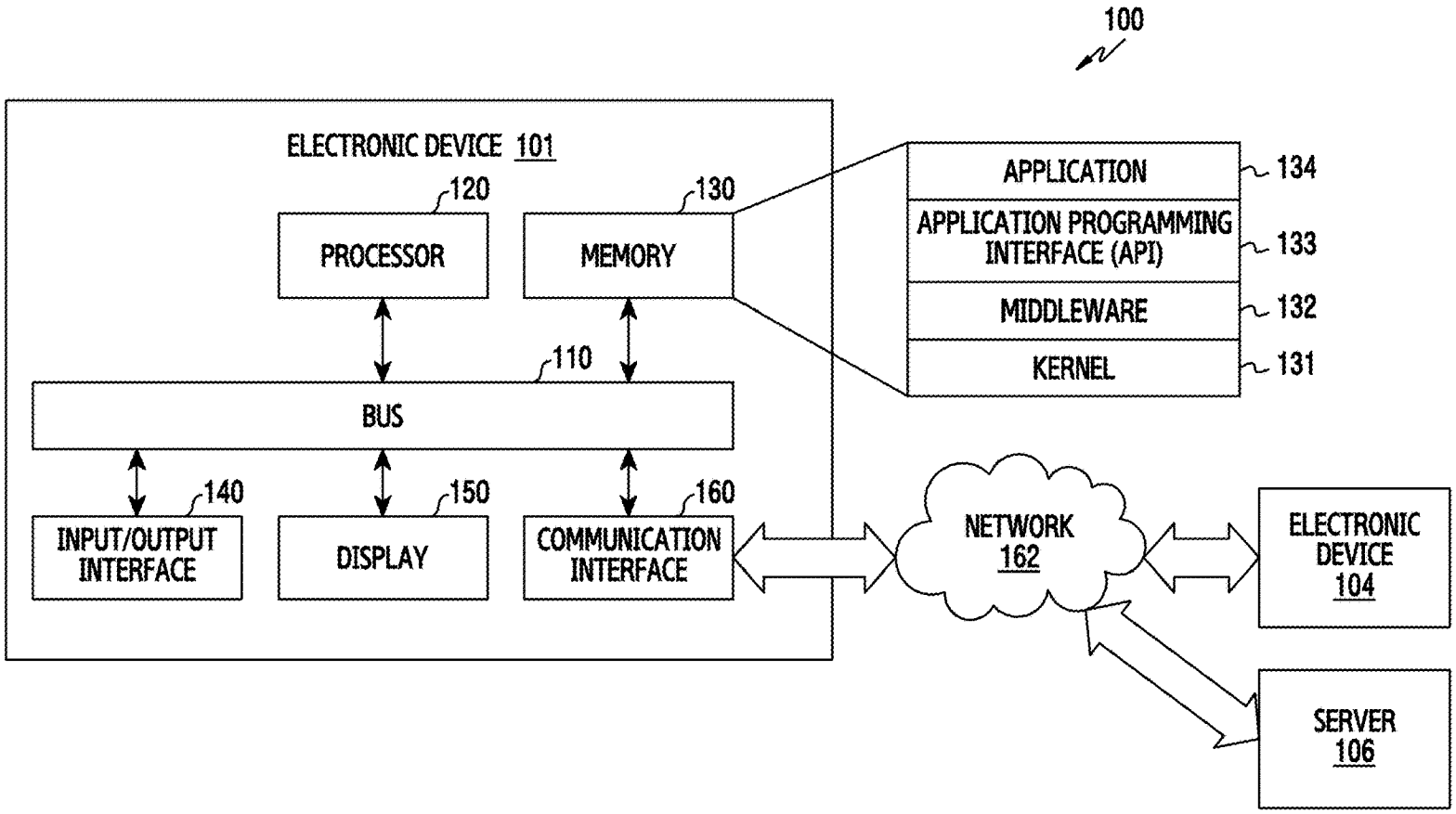
FIG. 1 is a diagram illustrating a network environment including an electronic device according to an embodiment of the present disclosure.

Herein, embodiments of the present disclosure are described with reference to the accompanying drawings. While the various embodiments of the present disclosure are susceptible to various modifications and alternative forms, specific embodiments thereof have been shown by way of example in the drawings and are described in detail herein. It should be understood, however, that it is not intended to limit the various embodiments of the present disclosure to the particular form disclosed, but on the contrary, the various embodiments of the present disclosure are to cover all modifications, equivalent, and alternatives falling within the spirit and scope of the various embodiments of the present disclosure as defined by the appended claims. Like reference numerals denote like elements throughout the drawings.

The expressions "include" or "may include" used in the various embodiments of the present disclosure are intended to indicate a presence of a corresponding function, operation, or element disclosed herein, and it is not intended to limit a presence of one or more functions, operations, or elements. In addition, in the various embodiments of the present disclosure, the terms "include" or "have" are intended to indicate that characteristics, numbers, steps, operations, elements, and elements disclosed in the specification or combinations thereof exist. As such, the terms "include" or "have" should be understood to mean that there are additional possibilities of one or more other characteristics, numbers, steps, operations, elements, elements or combinations thereof.

In various embodiments of the present disclosure, the expression "or" includes any and all combinations of words enumerated together. For example, "A or B" may include A or B, or may include both of A and B.

Although expressions used in various embodiments of the present disclosure such as "1$^{st}$", "2$^{nd}$", "first", "second" may be used to express various elements of the various embodiments, it is not intended to limit the corresponding elements. For example, the above expressions are not intended to limit an order or an importance of the corresponding elements. The above expressions may be used to distinguish one element from another element. For example, a first user device and a second user device are both user devices, and indicate different user devices. For example, a first element may be referred to as a second element, and similarly, the second element may be referred to as the first element without departing from the scope of the various embodiments of the present disclosure.

When an element is mentioned as being "connected" to or "accessing" another element, this may mean that it is directly connected to or accessing the other element, but it is to be understood that there are no intervening elements present. On the other hand, when an element is mentioned as being "directly connected" to or "directly accessing" another element, it is to be understood that there are no intervening elements present.

The term "substantially" indicates that the recited characteristic, parameter, or value need not be achieved exactly, but that deviations or variations, including but in no way limited to, for example, tolerances, measurement error, measurement accuracy limitations and other factors known to persons of ordinary skill in the art, may occur in amounts that do not preclude the effect the characteristic was intended to provide.

The terminology used in various embodiments of the present disclosure is for the purpose of describing particular embodiments only and is not intended to be limiting of the various embodiments of the present disclosure. A singular expression includes a plural expression unless there is a contextually distinctive difference therebetween.

Unless otherwise defined, all terms (including technical and scientific terms) used herein have the same meaning as commonly understood by those of ordinary skill in the art to which various embodiments of the present disclosure belong. It will be further understood that terms, such as those defined in commonly used dictionaries, should be interpreted as having meanings that are consistent with their meaning in the context of the relevant art and the various embodiments of the present disclosure, and will not be interpreted in an idealized or overly formal sense unless expressly defined herein.

An electronic device according to various embodiments of the present disclosure may be a device including an antenna capable of performing a communication function in at least one frequency band. For example, the electronic device may be a smart phone, a tablet Personal Computer (PC), a mobile phone, a video phone, an e-book reader, a desktop PC, a laptop PC, a netbook computer, a Personal Digital Assistant (PDA), a Portable Multimedia Player (PMP), a MPEG-1 Audio Layer 3 (MP3) player, a mobile medical device, a camera, and a wearable device (e.g., a Head-Mounted-Device (HMD) such as electronic glasses, electronic clothes, an electronic bracelet, an electronic necklace, an electronic appcessory, an electronic tattoo, or a smart watch).

According to certain embodiments, the electronic device may be a smart home appliance having an antenna. For example, the smart home appliance may include at least one of a TeleVision (TV), a Digital Video Disk (DVD) player, an audio, a refrigerator, an air conditioner, a cleaner, an oven, a microwave oven, a washing machine, an air purifier, a set-top box, a TV box (e.g., Samsung HomeSync™, Apple TV™, or Google TV™), a game console, an electronic dictionary, an electronic key, a camcorder, and an electronic picture frame.

According to certain embodiments, the electronic device including the antenna may be one of various medical devices (e.g., Magnetic Resonance Angiography (MRA), Magnetic Resonance Imaging (MRI), Computed Tomography (CT), imaging equipment, ultrasonic instrument, etc.), a navigation device, a Global Positioning System (GPS) receiver, an Event Data Recorder (EDR), a Flight Data Recorder (FDR), a car infotainment device, electronic equipment for ship (e.g., a vessel navigation device, a gyro compass, etc.), avionics, a security device, a car head unit, an industrial or domestic robot, an Automatic Teller Machines (ATM) of financial institutions, and merchant Point Of Sales (POS).

According to certain embodiments, the electronic device may be part of at least one of an item of furniture or a building/structure including an antenna. The electronic device may be an electronic board, an electronic signature input device, a projector, or any of various measurement machines (e.g., water supply, electricity, gas, propagation measurement machine, etc.). The electronic device may be one or more combinations of the aforementioned various devices. In addition, the electronic device may be a flexible device. Moreover, the electronic device is not limited to the aforementioned devices.

Hereinafter, an electronic device according to various embodiments will be described with reference to the accompanying drawings. The term 'user' used in the various embodiments refers to a person or entity using the electronic device, or a device which uses the electronic device (e.g., an Artificial Intelligence (AI) electronic device).

According to various embodiments of the disclosure, an antenna apparatus is provided for an electronic device having a Planar Inverted-F Antenna (PIFA) or monopole radiator as a basic structure. The volume and number of mounted antenna radiators are determined according to a frequency of service, bandwidth, and type of service, e.g., Long Term Evolution (LTE), Bluetooth® (BT), Global Positioning System (GPS), and Wireless Fidelity (WiFi) services. The electronic devices provide service in the aforementioned communication bands utilizing an antenna provided within a given mounting space of the antenna radiator, that outputs an electric field less than or equal to an acceptable Specific Absorption Rate (SAR), to overcome a radiation performance interference caused by peripheral metal parts, e.g., a metal housing, a metal bezel, and an electronic component using metal materials.

FIG. 1 is a diagram illustrating a network environment 100 including an electronic device 101 according to an embodiment of the present disclosure.

Electronic device 101 may include a bus 110, a processor 120, a memory 130, an input/output interface 140, a display 150, and a communication interface 160.

The bus 110 may be a circuit for connecting the aforementioned elements to each other and for delivering communication (e.g., a control message) between the aforementioned elements.

The processor 120 may receive an instruction from the aforementioned different elements (e.g., the memory 130, the input/output interface 140, the display 150, the communication interface 160, etc.), for example, via the bus 110, and thus may interpret the received instruction and execute arithmetic or data processing according to the interpreted instruction.

The memory 130 stores an instruction or data received from the processor 120 or different elements (e.g., the input/output interface 140, the display 150, the communication interface 160, etc.) or generated by the processor 120 or the different elements. The memory 130 may include programming modules such as a kernel 131, a middleware 132, an Application Programming Interface (API) 133, an application 134, and the like. Each of the aforementioned programming modules may consist of software, firmware, or hardware entities or may consist of at least two or more combinations thereof.

The kernel 131 may control or manage the remaining other programming modules, for example, system resources (e.g., the bus 110, the processor 120, the memory 130, etc.) used to execute an operation or function implemented in the middleware 132, the API 133, or the application 134. In addition, the kernel 131 may provide a controllable or manageable interface by accessing individual elements of the electronic device 101 in the middleware 132, the API 133, or the application 134.

The middleware 132 performs a mediation role so that the API 133 or the application 134 communicates with the kernel 131 to exchange data. In addition, regarding task requests received from the application 134, for example, the middleware may perform a control (e.g., scheduling or load balancing) for the task requests by using a method of assigning a priority capable of using a system resource (e.g., the bus 110, the processor 120, the memory 130, etc.) of the electronic device 101 to at least the application 134.

The API 133 may include at least one interface or function (e.g., instruction) for file control, window control, video processing, character control, and the like, as an interface capable of controlling a function provided by the application 134 in the kernel or the middleware 132.

The application 134 may include an Short Message Service (SMS)/Multimedia Messaging Service (MMS) application, an e-mail application, a calendar application, an alarm application, a health care application (e.g., an application for measuring a physical activity level, a blood sugar, etc.) or an environment information application (e.g., atmospheric pressure, humidity, or temperature information). Additionally or alternatively, the application 134 may be an application related to an information exchange between the electronic device 101 and an external electronic device (e.g., another electronic device or server 106). The application related to the information exchange may include, for example, a notification relay application for relaying specific information to the external electronic device or a device management application for managing the external electronic device.

For example, the notification relay application may include a function of relaying notification information generated in another application (e.g., an SMS/MMS application, an e-mail application, a health care application, an environment information application, etc.) of the electronic device 101 to the external electronic device. Additionally or alternatively, the notification relay application may receive notification information, for example, from the external electronic device and may provide it to a user. The device management application may manage, for example, a function for at least one part of the external electronic device which communicates with the electronic device 101. Examples of the function include turning on/turning off the external electronic device itself (or some components thereof) or adjusting of a display illumination (or a resolution), and managing (e.g., installing, deleting, or updating) an application which operates in the external electronic device or a service (e.g., a call service or a message service) provided by the external electronic device.

The application 134 may include an application specified according to attribute information (e.g., an electronic device type) of the external electronic device. For example, if the external electronic device is an MP3 player, the application 134 may include an application related to a music play. Similarly, if the external electronic device is a mobile medical device, the application 134 may include an application related to a health care. The application 134 may include at least one of a specified application in the electronic device 101 or an application received from the external electronic device.

The input/output interface 140 may relay an instruction or data input from the user by using a sensor (e.g., an acceleration sensor, a gyro sensor) or an input device (e.g., a keyboard or a touch screen) to the processor 120, the memory 130, or the communication interface 160, for example, via the bus 110. For example, the input/output interface 140 may provide data regarding a user's touch input via the touch screen to the processor 120. In addition, the input/output interface 140 may output an instruction or data received from the processor 120, the memory 130, or the communication interface 160 to an output device (e.g., a speaker or a display), for example, via the bus 110. For example, the input/output interface 140 may output audio data provided by using the processor 120 to the user via the speaker.

The display 150 may display a variety of information (e.g., multimedia data or text data) to the user.

The communication interface 160 facilitates communication between the electronic device 101 and an external device (e.g., the another electronic device 104 or the server 106). The communication interface 160 may include an antenna part 300 (FIG. 3A), examples of which are described herein. For example, the communication interface may communicate with the external device by being connected with a network 162 through wireless communication or wired communication. The wireless communication may include, for example, at least one of Wireless Fidelity (Wi-Fi), Bluetooth® (BT), Near Field Communication (NFC), Global Positioning System (GPS), and cellular communication (e.g., LTE, LTE-A, CDMA, WCDMA, UMTS, WiBro, GSM, etc.). The wired communication may include, for example, at least one of Universal Serial Bus (USB), High Definition Multimedia Interface (HDMI), Recommended Standard (RS)-232, and Plain Old Telephone Service (POTS).

The network 162 may be a telecommunications network. The telecommunications network may include at least one of a computer network, the Internet, the Internet of Things, and a telephone network. A protocol (e.g., a transport layer protocol, a data link layer protocol, or a physical layer protocol) for communication between the electronic device 101 and an external device may be supported in at least one of the application 134, the application programming interface 133, the middleware 132, the kernel 131, and the communication interface 160.

Embodiments of the present disclosure describe an antenna apparatus arranged around a metal bezel contributing to an appearance of the housing of an electronic device, but are not so limited. For instance, the antenna apparatus may be also designed to have a structure capable of preventing radiation performance deterioration caused by other metal parts arranged around the antenna apparatus within the electronic device, not a metal housing.

Figure 2A:
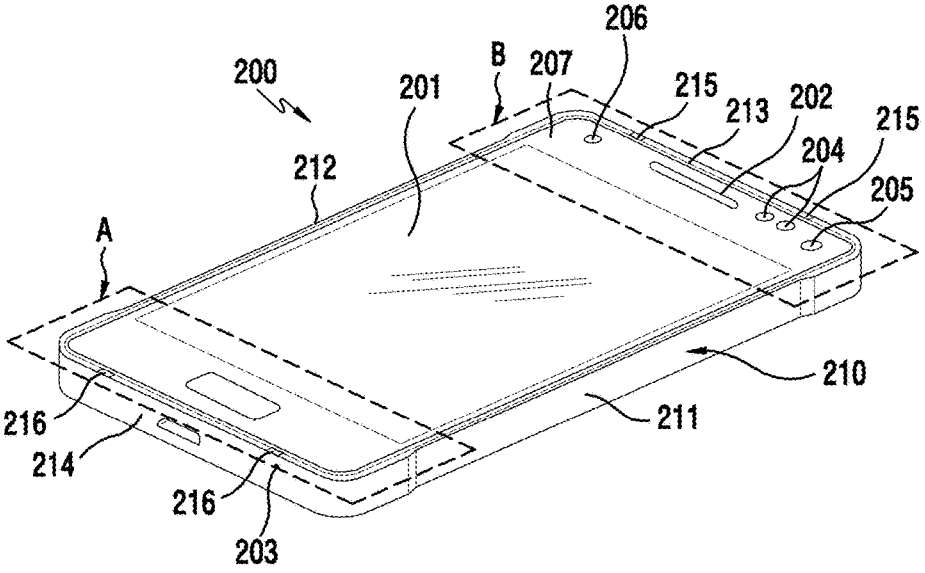
FIG. 2A is a front perspective view of an electronic device applying a metal bezel according to an embodiment of the present disclosure.
Figure 2B:
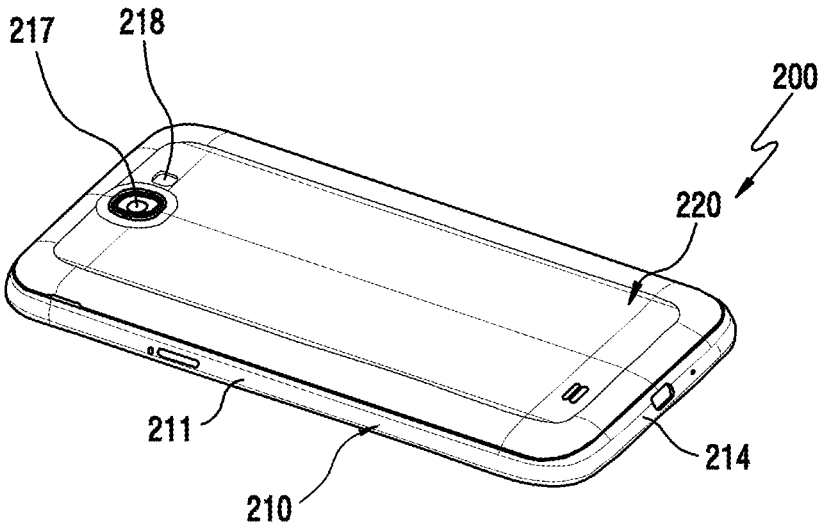
FIG. 2B is a rear perspective view of the electronic device applying a metal bezel according to an embodiment of the present disclosure.

FIG. 2A is a front perspective view of an electronic device 200 applying a metal bezel 210 according to various embodiments of the present disclosure. FIG. 2B is a rear perspective view of the electronic device 200 applying the metal bezel 210 according to the present disclosure.

Referring to FIG. 2A, a display 201 is installed in a front surface 207 of the electronic device 200. A speaker device 202 is installed at an upper side of the display 201, to output a voice of a counterpart. A microphone device 203 is installed at a lower side of the display 201, and transmits a voice input to the electronic device to the counterpart.

According to one embodiment, components for performing various functions of the electronic device 200 are arranged around the speaker device 202. The components include at least one sensor module 204. This sensor module 204 may, for instance, include at least one of an illumination sensor (e.g., an optical sensor), a proximity sensor (e.g., an optical sensor), an infrared sensor, and an ultrasonic sensor. According to one embodiment, the components include a camera device 205. According to one embodiment, the components also include a Light Emitting Diode (LED) indicator 206 for allowing a user to recognize status information of the electronic device 200.

According to various embodiments, the electronic device 200 includes a metal bezel 210, which contributes to at least a partial region of the metal housing. According to one embodiment, the metal bezel 210 is arranged along an edge of the electronic device 200, and may extend from the edge to at least a partial region of a rear surface of the electronic device 200. According to one embodiment, the metal bezel 210 defines a thickness of the electronic device 200 along the edge of the electronic device 200, and is formed in a loop shape, it is not so limited, with the metal bezel 210 alternatively being formed to contribute to at least a part of the thickness of the electronic device 200. According to one embodiment, the metal bezel 210 may be also arranged only in at least a partial region on the edge of the electronic device 200. According to one embodiment, when the metal bezel 210 contributes to a part of a housing of the electronic device 200, the remaining part of the housing may be replaced with a non-metallic member. In this case, the metal bezel 210 may be formed by insert injecting or insert molding the non-metallic member or in a manner of assembly. According to one embodiment, the metal bezel 210 also includes at least one segment part 215 or 216, and unit bezel parts 211, 212, 213 and 214 segmented by the segment parts 215 and 216 may be also utilized as antenna radiators.

According to various embodiments, the metal bezel 210 may have a loop shape along the edge of the electronic device 200, and may be arranged to form the entire depth or thickness of the electronic device 200. According to one embodiment, when viewing the electronic device 200 from the front, the metal bezel 210 may be formed to include a right bezel part 211, a left bezel part 212, an upper bezel part 213, and a lower bezel part 214. Herein, the aforementioned unit bezel parts 211, 212, 213 and 214 contribute to the unit bezel parts formed by the segment parts 215 and 216.

According to an embodiment of the disclosure, the antenna apparatus is arranged in an 'A' region or 'B' region (FIG. 2A) of the electronic device 200 that are least affected when the electronic device 200 is held in a user's hand. The antenna apparatus is not so limited, and may be also arranged in a lengthwise direction in at least one lateral surface on both lateral surfaces of the electronic device 200, other than the 'A' region or 'B' region.

Referring to FIG. 2B, a cover member 220 is installed on a rear surface of the electronic device 200. The cover member 220 may be a battery cover to protect a battery pack detachably installed in the electronic device 200 and to improve the appearance of the electronic device 200. The cover member 220 may also be integrated with the electronic device 200 and contribute to an external housing of the electronic device 200. According to an embodiment, a camera device 217 and a flash 218 are arranged in a rear surface of the electronic device 200.

According to various embodiments, the metal bezel 210 may be formed to extend to at least a partial region of the cover member 220. In this case, the metal bezel 210 and an extended metal material portion of the cover member 220 may be formed in an integral form, and a remaining portion of the cover member 220 may be formed of synthetic resin materials, such that the extended metal material portion and remaining synthetic resin material portion of the cover member 220 are completed as one cover member, by insert molding or similar assembly.

Figure 3A:
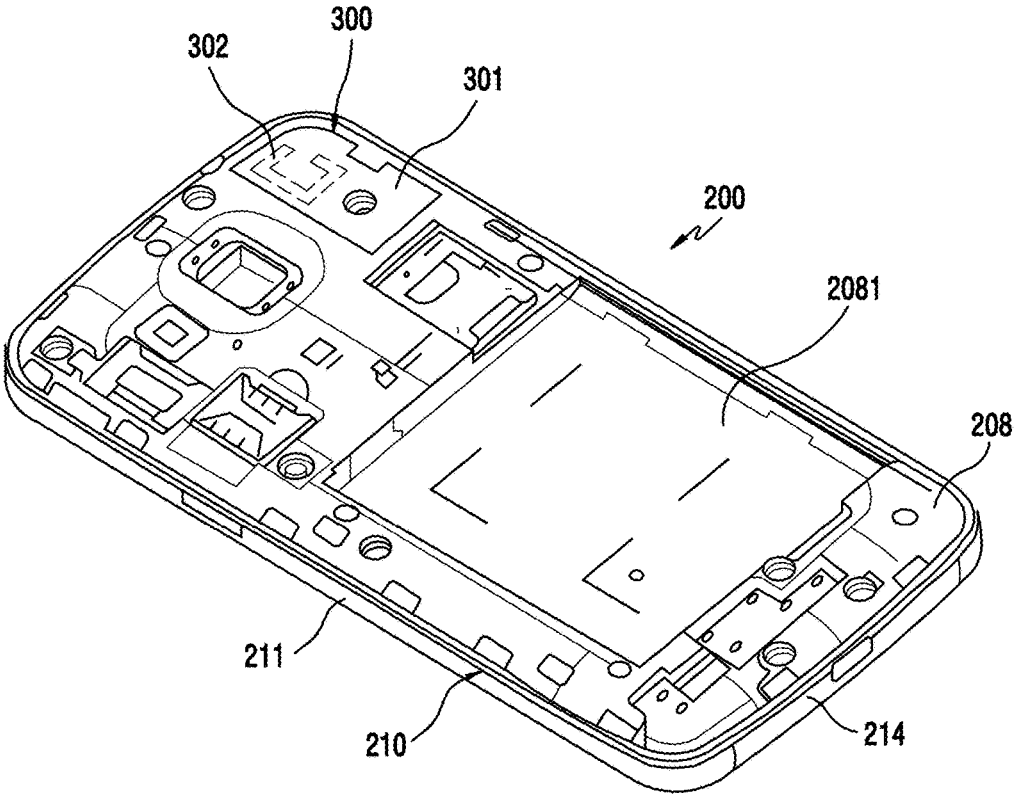
FIG. 3A is a perspective diagram illustrating a state of releasing a cover member of an electronic device including an antenna part according to an embodiment of the present disclosure.

FIG. 3A is a perspective diagram illustrating a state of releasing the cover member of the electronic device 200 including an antenna part 300 according to an embodiment of the present disclosure.

Referring to FIG. 3A, the antenna part 300 may be arranged in at least a partial region excepting a battery pack mounting part 2081, on a rear surface 208 of the electronic device 200 from which the cover member is released. The antenna part 300 forms an antenna radiator 302 having a certain radiation pattern of conductive materials, in an antenna frame 301 of synthetic resin materials. According to one embodiment, the antenna radiator 302 may be formed in the antenna frame 301 in an in-mold form.

According to various embodiments, the antenna part 300 is arranged in one region on a rear surface of the electronic device 200, but it is not limited to this. For instance, the antenna part 300 may be arranged in at least one region among an upper left and right region of the electronic device 200 and a lower left and right region thereof.

Figure 3B:
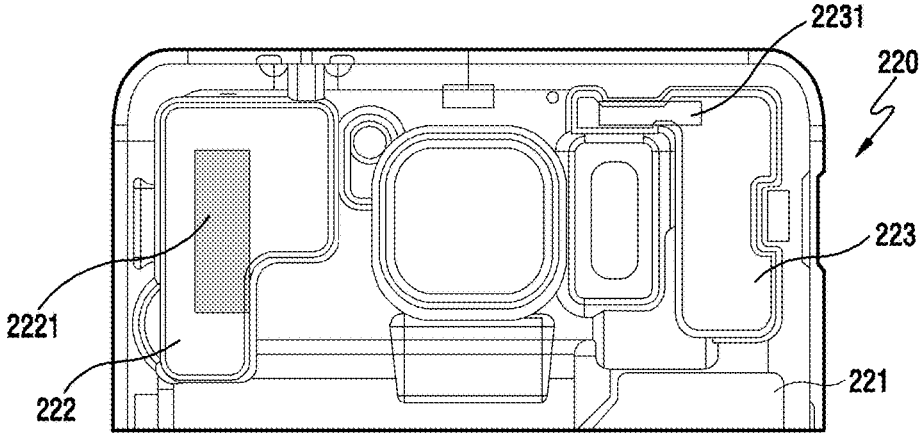
FIG. 3B illustrates construction of a portion of a cover member according to an embodiment of the present disclosure.

FIG. 3B illustrates construction of a portion of a cover member according to an embodiment of the present disclosure.

According to an embodiment of the present disclosure, the electronic device 200 further includes at least one sub antenna radiator 2221 or 2231 (FIG. 3B) electrically connected to and positioned near the antenna radiator 302, to prevent deterioration of the radiation performance of the antenna radiator 302 of the antenna part 300 arranged in a rear surface of the electronic device 200 due to the metal bezel 210 (FIG. 3A) installed near the antenna radiator 302. According to one embodiment, the sub antenna radiators and 2231 are coupled with the antenna radiator 302. The sub antenna radiators 2221 and 2231 may be implemented in a parasitic patch form. The sub antenna radiators 2221 and 2231 tune positions of a radiation pattern and peak gain of an antenna apparatus based on a distance from the antenna radiator 302, an overlapped area, and a shape of a patch. According to an embodiment, the sub antenna radiators 2221 and 2231 are electrically connected with the antenna radiator 302 by direct physical contact.

Referring to FIG. 3B, at least one sub antenna radiator 2221 or 2231 is arranged in a patch form in a first region 222 or a second region 223 on an inner surface 221 of the cover member 220. According to one embodiment, the second antenna radiator 2221 is arranged in various manners in at least a part of the first region 222 of the cover member 220. According to one embodiment, the third antenna radiator 2231 may be arranged in various manners in at least a part of the second region 223 of the cover member 220.

According to various embodiments, the sub antenna radiator 2221 or 2231 is arranged as a thin board of metal material attached in a patch form to the inner surface 221 of the cover member 220. The sub antenna radiator 2221 or 2231 may alternatively include at least one of a Flexible Printed Circuit (FPC) including a metal pattern, a conductive tape, and a conductive paint. According to one embodiment, the sub antenna radiator 2221 or 2231 utilizes the existing used structure or electronic component of metal material of the electronic device 200. According to one embodiment, the structure or electronic component of the metal material includes at least one of a metal tape, a part of a shield can, a bushing of metal materials having a certain width, a metal bracket, and a flexible printed circuit for a touch key.

For instance, the sub antenna radiator 2221 or 2231 is arranged around the metal parts (e.g., a metal bezel). Various metal materials for tuning a radiation pattern and/or a peak gain may contribute to a parasitic antenna radiator to prevent radiation performance deterioration caused by the metal parts.

Figure 4A:
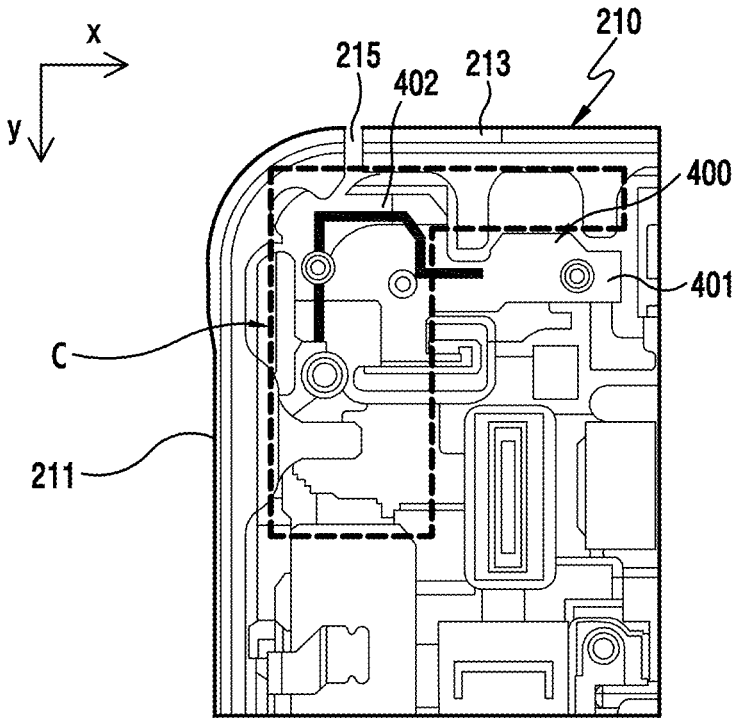
FIG. 4A illustrates the arrangement of an antenna radiator and a sub antenna radiator according to an embodiment of the present disclosure.

FIG. 4A illustrates the arrangement of an antenna radiator and a sub antenna radiator according to an embodiment of the present disclosure.

Referring to FIG. 4A, the metal bezel 210 may form all or part of an edge of the electronic device 200. An antenna part 400 including an antenna frame 401 and an antenna radiator 402 formed in the antenna frame 401 are arranged around a corner region where the right bezel part 211 and the upper bezel part 213 encounter each other. According to one embodiment, an arrangement region 'C' of a sub antenna radiator (e.g., an inner surface of a cover member) arranged around the antenna part 400 generally overlaps with the antenna radiator 402 in a Z-axis direction, and in a position where coupling is possible. According to one embodiment, if the upper bezel part 213 segmented as the unit bezel parts by the segment part 215 is used as another antenna radiator, the arrangement region 'C' of the sub antenna radiator is positioned to couple with the upper bezel part 213, and is used as a sub antenna radiator. The arrangement region 'C' of the sub antenna radiator is not so limited, and may couple with the antenna radiator 402 without change of position along the Z-axis direction. The arrangement region 'C' of the sub antenna radiator may be also located in various an X-axis and Y-axis positions on the same position of the Z-axis as the antenna radiator 402 to not overlap with the antenna radiator 402.

Figure 4B:
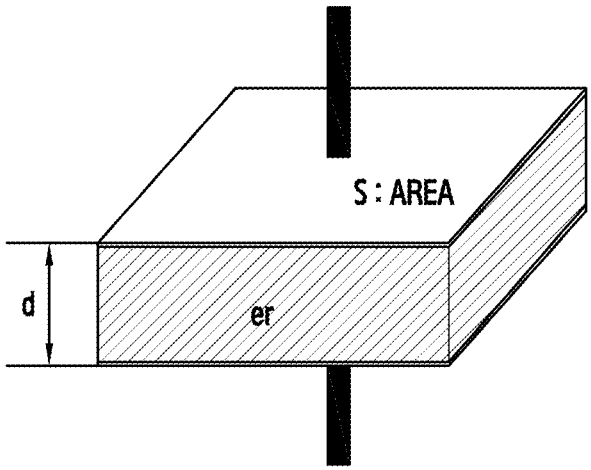
FIG. 4B illustrates a capacitance of a dielectric substance between two metal plates according to an embodiment of the present disclosure.
Figure 4C:
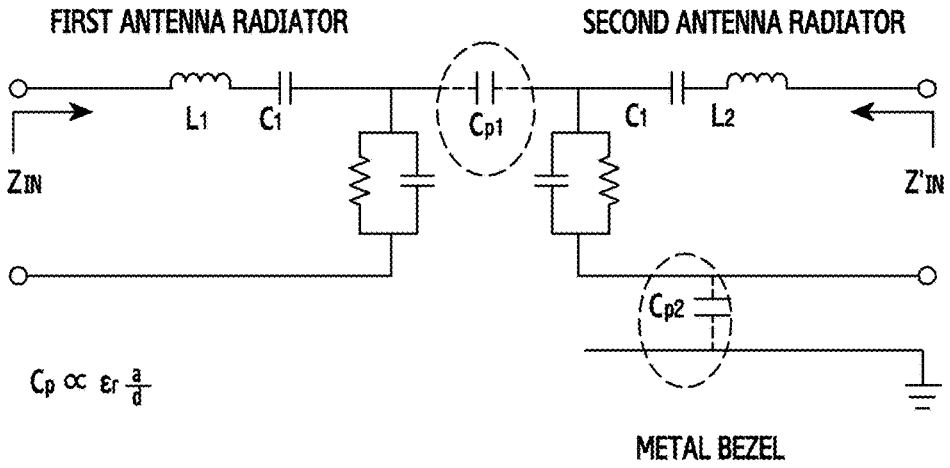
FIG. 4C is an equivalent circuit diagram illustrating an antenna apparatus applying a sub antenna radiator according to an embodiment of the present disclosure.

FIG. 4B illustrates a capacitance of a dielectric substance between two metal plates according to an embodiment of the present disclosure. FIG. 4C is an equivalent circuit diagram illustrating an antenna apparatus applying a sub antenna radiator according to an embodiment of the present disclosure.

Referring to FIG. 4B and FIG. 4C, an area (S) of a metal plate dependent on a capacitance (C) value may be calculated using a permittivity of a dielectric substance (air and a case frame) interposed between two metal plates, using Equation (1):

$$C = \varepsilon \frac{S}{d} \tag{1}$$

In Equation (1), 'C' is a capacitance between the two metal plates, 'S' is an area of each of the two metal plates, 'd' is a distance between the two metal plates, and 'ε' is $\varepsilon r \times \varepsilon 0$, with εr being relative permittivity and $\varepsilon 0 = 8.854 \times 10^{-12}$. That is, a desired capacitance C, e.g., Cp1 and Cp2 (FIG. 4C), may be calculated considering a relationship in which the capacitance C value is inversely proportional to a spaced distance (d) of the two plates and is proportional to the area (S) of each of the two metal plates. Accordingly, if a capacitance C value is given considering an impedance value at a desired frequency band, the area (S) of each of the two metal plates considering the spaced distance (d) may be calculated.

FIGS. 5A to 5D illustrate various attachment states of a sub antenna radiator according to various embodiments of the present disclosure.

Figure 5A:
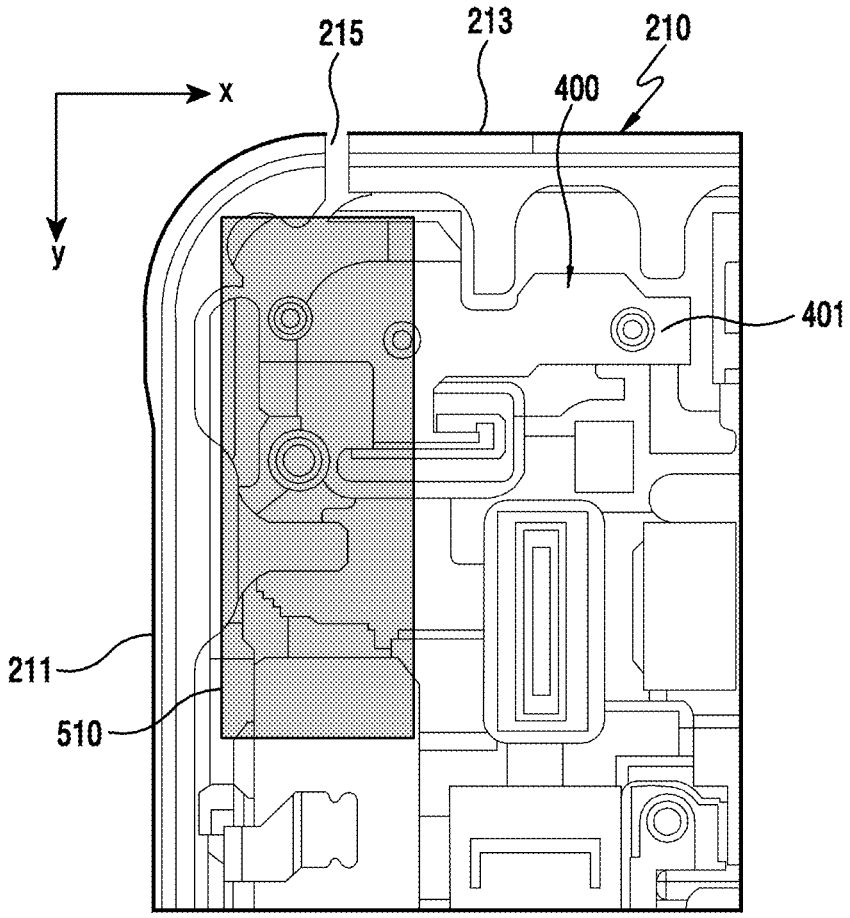
FIGS. 5A to 5D illustrate various attachment states of a sub antenna radiator according to embodiments of the present disclosure.

Referring to FIG. 5A, the metal bezel 210 forms an edge of the electronic device 200. The antenna part 400 including the antenna frame 401 and an antenna radiator formed in the antenna frame 401 are arranged around a corner region where the right bezel part 211 and the upper bezel part 213 encounter each other. According to one embodiment, the upper bezel part 213 is segmented by the segment part 215 and is used as another sub antenna radiator. According to the embodiment of FIG. 5A, a sub antenna radiator 510 is arranged in a lengthwise direction, i.e., the Y-axis direction, of the metal bezel 210.

Figure 5B:
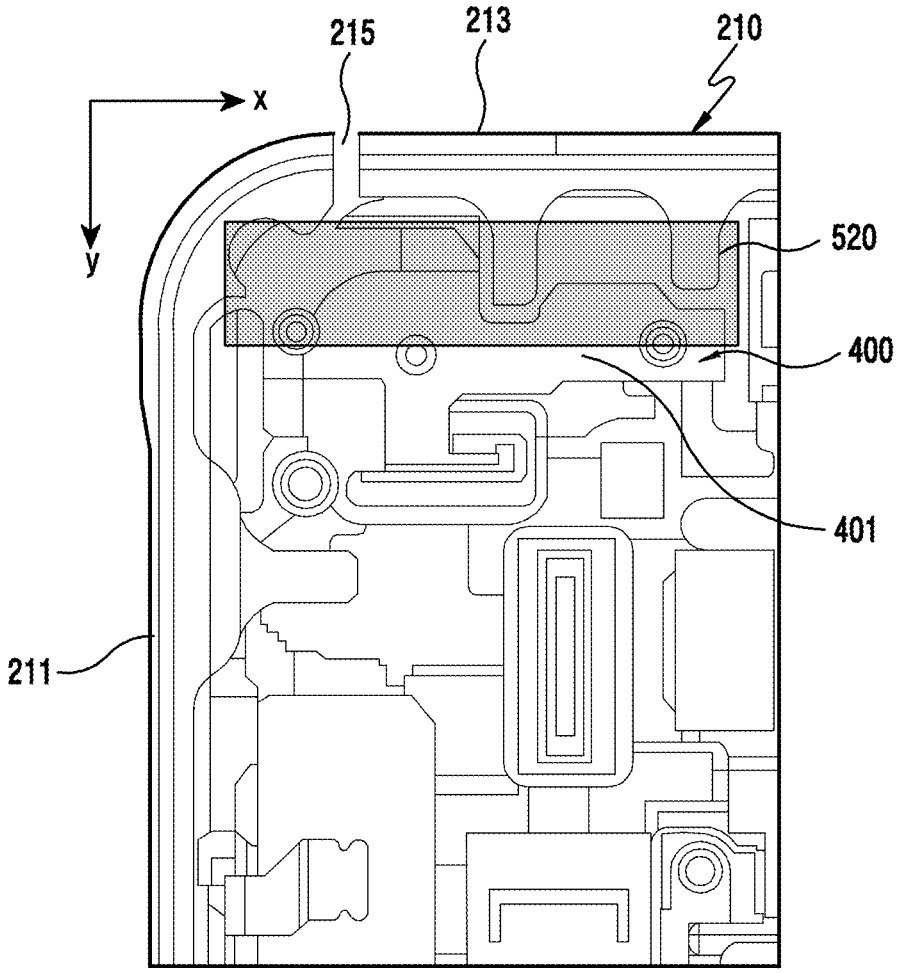

In the embodiment of FIG. 5B, a sub antenna radiator 510 is arranged in a width direction, i.e., the X-axis direction, of the metal bezel 210, with the upper bezel part 213, as segmented by the segment part 215, being used as another sub antenna radiator.

Figure 5C:
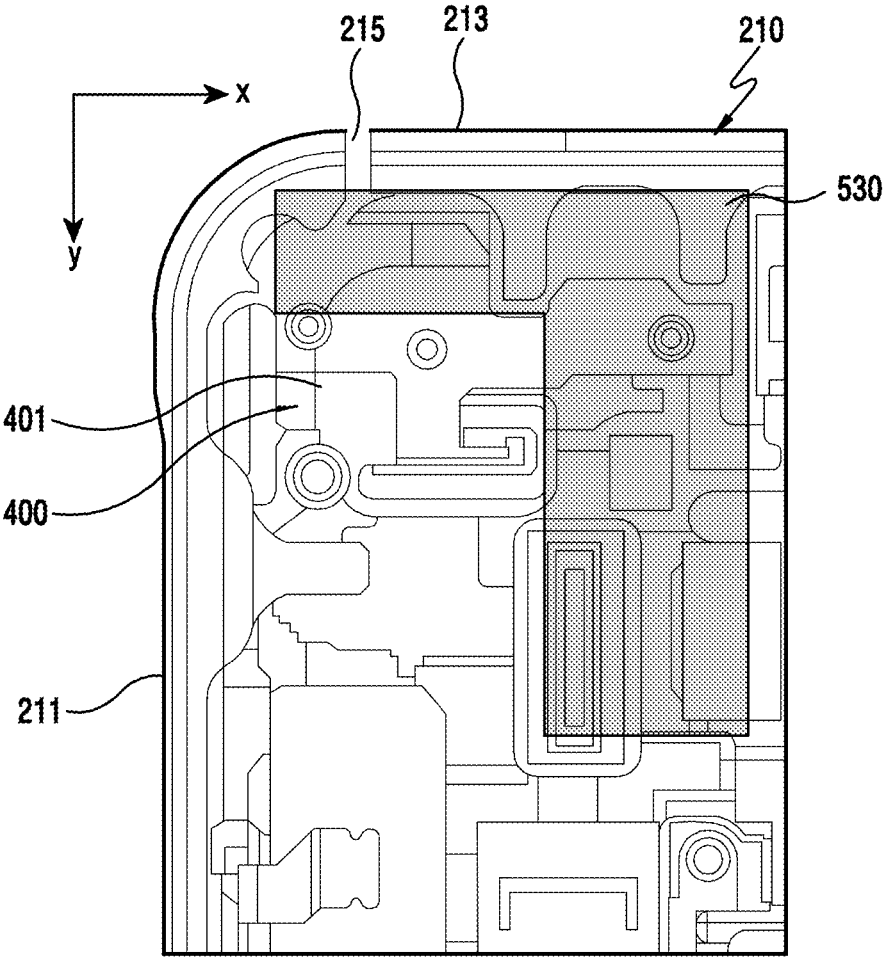

In the embodiment of FIG. 5C, a sub antenna radiator 530 is arranged in a bent arrangement, extending in a width direction, i.e., in the X-axis direction, and also extending in a lengthwise direction, i.e., in the Y-axis direction, of the metal bezel 210. A region of the width direction of the sub antenna radiator 530 is arranged close to the upper bezel part 213, and a region of the lengthwise direction is arranged in a position spaced near to the right bezel part 211.

Figure 5D:
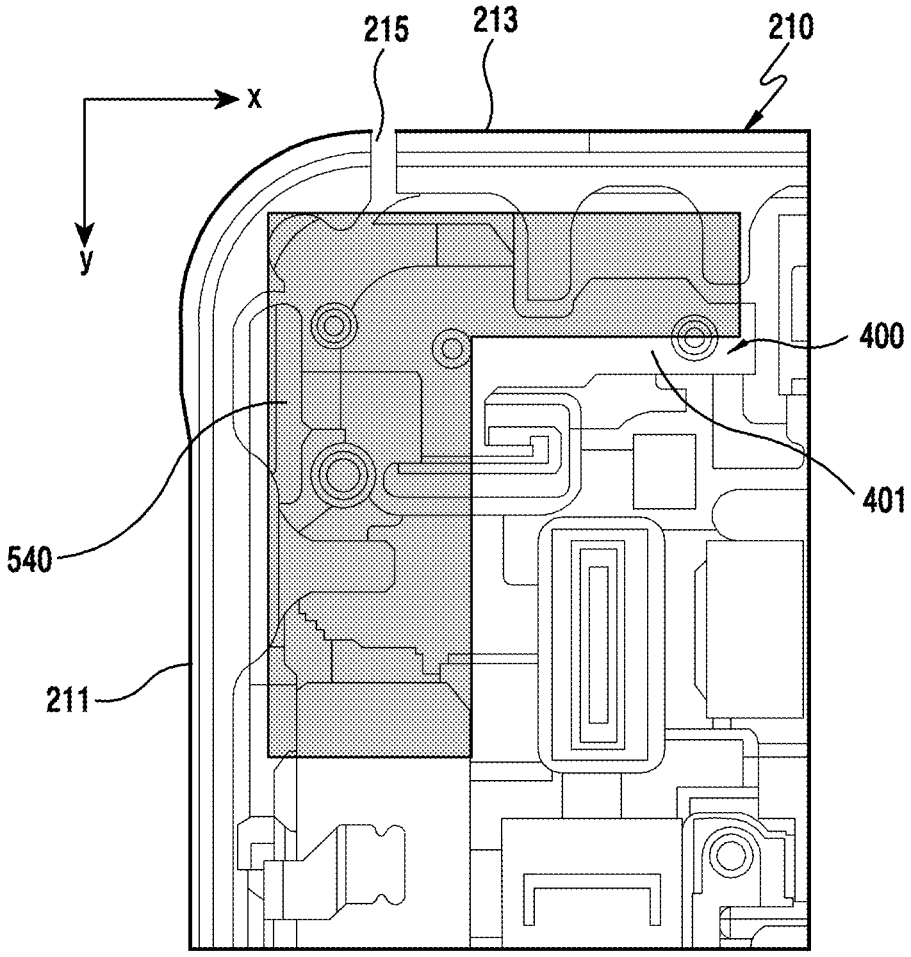

In the embodiment of FIG. 5D, a sub antenna radiator 540 is arranged in the lengthwise direction, i.e., the Y-axis direction, of the metal bezel 210, and the sub antenna radiator 540 is bent in a width direction, i.e., the X-axis direction, at an upper end thereof after extended in a lengthwise direction, i.e., the Y-axis direction, of the metal bezel 210. A region of the width direction of the sub antenna radiator 540 is arranged close to the upper bezel part 213, and a region of the lengthwise direction is arranged in a position spaced apart from the right bezel part 211.

According to various embodiments, the sub antenna radiators 510, 520, 530, and (as shown in FIGS. 5A, 5B, 5C and 5D, respectively) determine the performance of an antenna apparatus by at least one of a distance from the antenna radiator, a distance from an overlapped area, a position, and a shape of each sub antenna radiator.

FIGS. 6A to 6D are diagrams illustrating states of applying to a cover member a sub antenna radiator according to embodiments of the present disclosure.

According to various embodiments, a sub antenna radiator 610 used as a parasitic antenna radiator is positioned to be coupled with an antenna radiator 602 arranged in a body of an electronic device. According to one embodiment, the sub antenna radiator 610 is arranged in a cover member 630 of the electronic device, the cover member 630 may be a battery cover of the electronic device, may be an external housing of the electronic device, or may be an internal housing (e.g., a bracket) of the electronic device.

Referring to FIGS. 6A-6D, the antenna radiator 602 is arranged in an antenna frame 601 (e.g., a carrier, and an in-molded structure) installed within the body of the electronic device. The sub antenna radiator 610 is arranged as a parasitic antenna radiator in a position of the cover member 630 that allows for electrical coupling with the antenna radiator 602. According to the embodiment of FIG. 6A, the sub antenna radiator 610 is attached to an inner surface of the cover member 630 in a patch form.

Figure 6A:
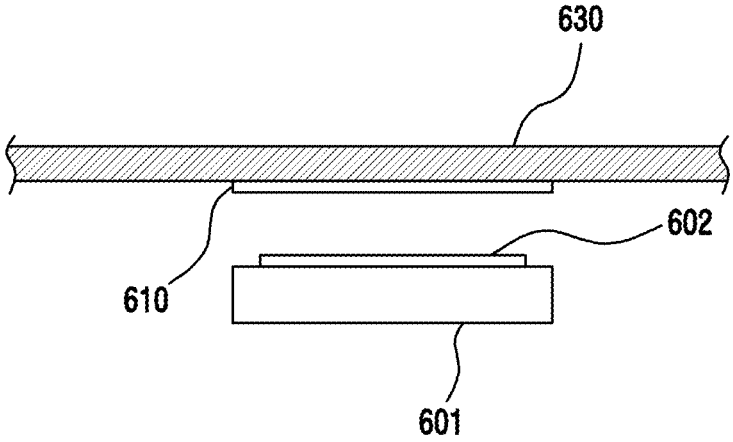
FIGS. 6A to 6D are diagrams illustrating states of applying to a cover member a sub antenna radiator according to embodiments of the present disclosure.
Figure 6B:
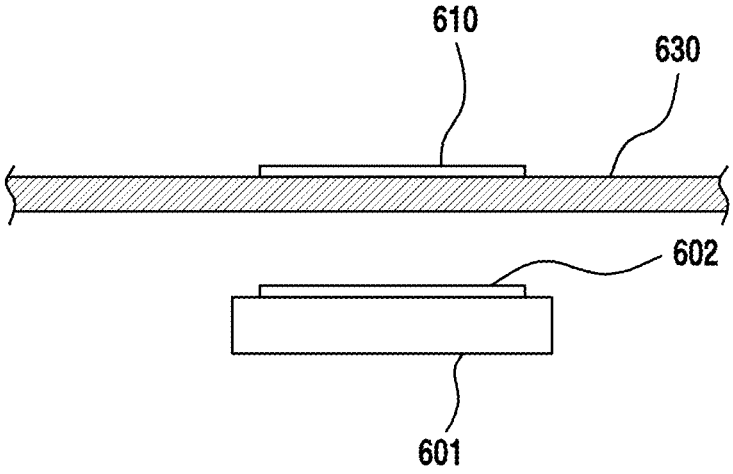

According to the embodiment of FIG. 6B, the sub antenna radiator 610 is attached to an outer surface of the cover member 630 in a patch form that allows the sub antenna radiator 610 to contribute to a decoration of the cover member 630.

Figure 6C:
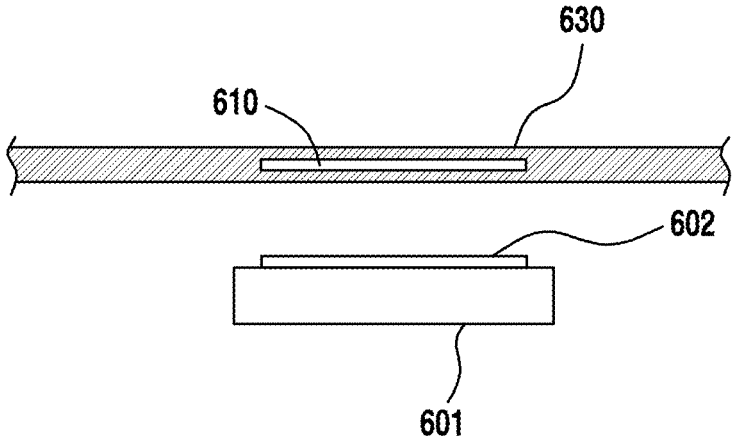

According to the embodiment of FIG. 6C, when the cover member 630 of synthetic resin materials is injected, the sub antenna radiator 610 is insert injected therein.

Figure 6D:
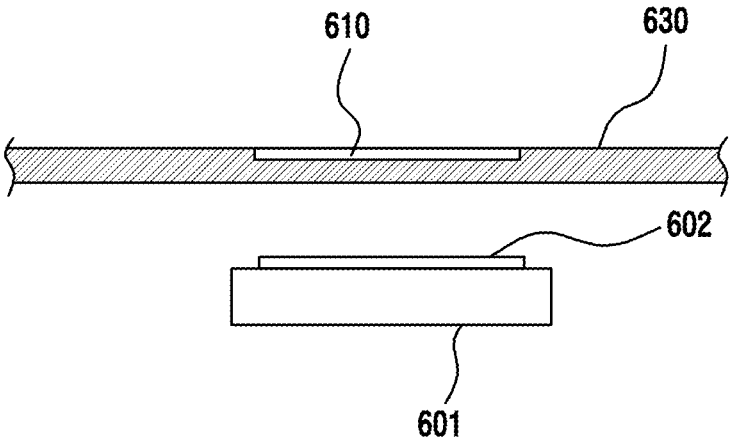

According to the embodiment of FIG. 6D, the sub antenna radiator 610 is safely mounted in a recess provided in an outer surface of the cover member 630 such that surfaces of the sub antenna radiator 610 and the cover member 630 are made consistent. Like the embodiment of FIG. 6B, the sub antenna radiator 610 may contribute to the decoration of the cover member 630.

Figure 7:
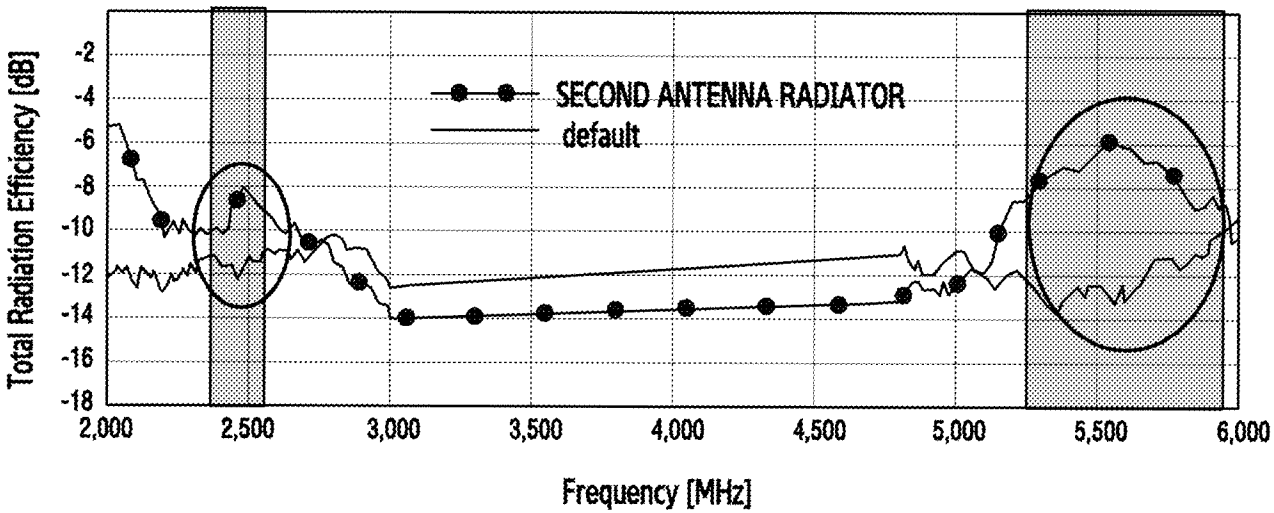
FIG. 7 is a graph comparing the radiation efficiencies of an antenna apparatus before and after applying a sub antenna radiator according to various embodiments of the present disclosure.

FIG. 7 is a graph comparing the radiation efficiencies of an antenna apparatus before and after applying a sub antenna radiator according to various embodiments of the present disclosure. As shown in FIG. 7, applying of the sub antenna radiator results in an improvement of the radiation efficiency of a maximum of 6 decibels (dB), dependent on frequency range.

According to various embodiments of the present disclosure, deterioration of radiation performance caused by metal parts near an antenna radiator is prevented, rigidity of an electronic device is improved, and the appearance of the electronic device is improved, while also exhibiting relatively high radiation efficiency, by utilizing a antenna radiator mounted in the same amount of mounting space.

Figure 8:
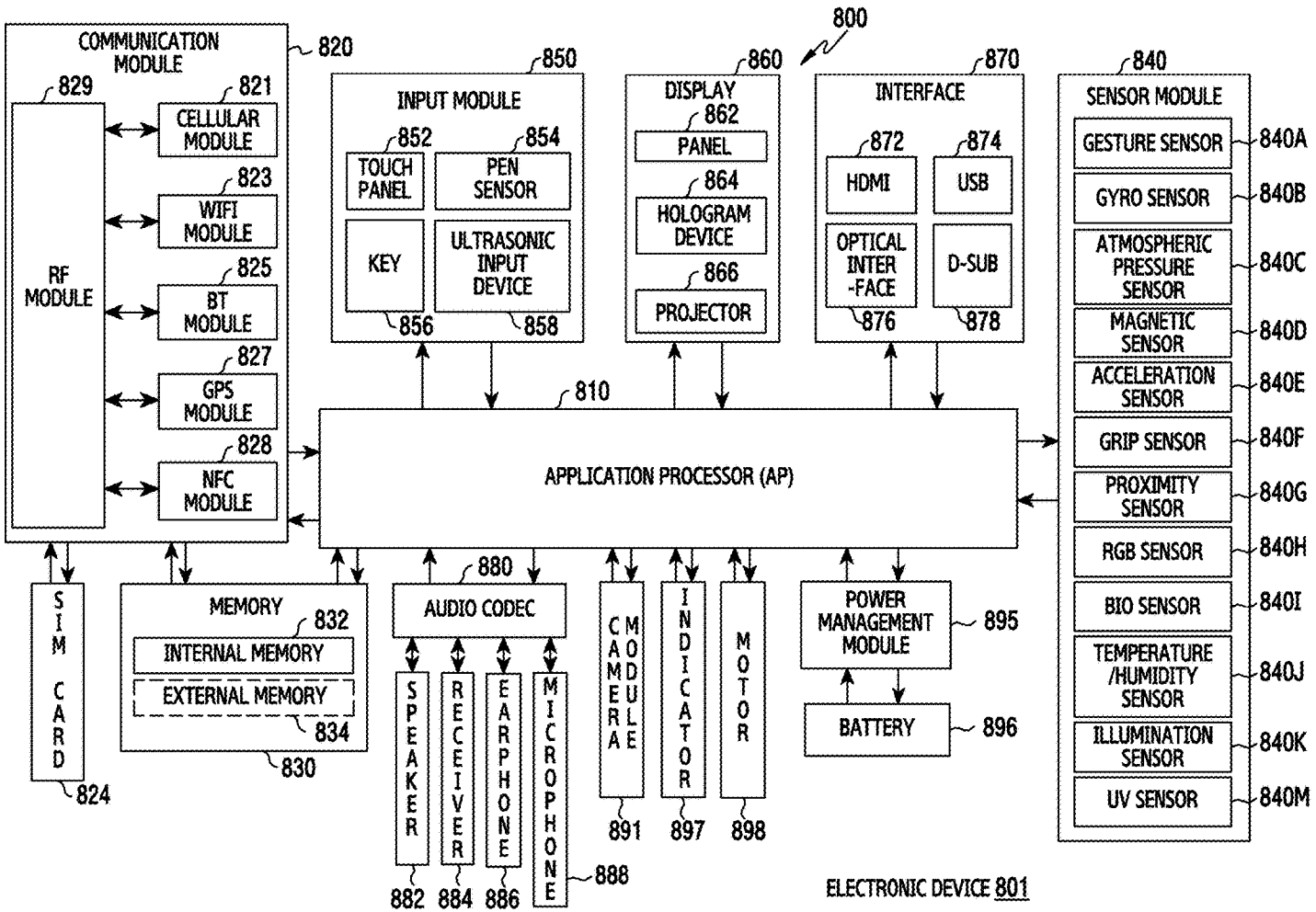
FIG. 8 is a block diagram illustrating components of an electronic device according to various embodiments of the present disclosure.

FIG. 8 is a block diagram illustrating components of an electronic device according to various embodiments of the present disclosure.

As shown in FIG. 8, the electronic device 801 may entirely or partially constitute, for example, the electronic device 101 of FIG. 1 and/or the device 200 of FIGS. 2A-3A. Electronic device 801 includes at least one Application Processor (AP) 810, a communication module 820, a Subscriber Identification Module (SIM) card 824, a memory 830, a sensor module 840, an input module 850, a display 860, an interface 870, an audio module, e.g., audio coder/decoder (CODEC) 880, a camera module 891, a power management module 895, a battery 896, an indicator 897, and a motor 898.

The AP 810 controls a plurality of hardware or software elements connected to the AP 810 by driving an operating system or an application program, and processes a variety of data including multimedia data and performs an arithmetic operation. The AP 810 may be implemented, for example, with a System on Chip (SoC). The AP 810 may further include a Graphic Processing Unit (GPU).

The communication module 820 (e.g., the communication interface 160) performs data transmission/reception in communication with external electronic devices (e.g., the another electronic device 104 and/or the server 106) connected with the electronic device 801 (e.g., the electronic device 101) through a network. The communication module 820 may include a cellular module 821, a Wi-Fi module 823, a BlueTooth® (BT) module 825, a Global Positioning System (GPS) module 827, a Near Field Communication (NFC) module 828, and a Radio Frequency (RF) module 829. The cellular module 821 may provide a voice call, a video call, a text service, Internet service, and the like through a communication network (e.g., LTE, LTE-A, CDMA, WCDMA, UMTS, WiBro, GSM, etc.). In addition, the cellular module 821 may identify and authenticate the electronic device within the communication network by using a subscriber identity module (e.g., the SIM card 824). The cellular module 821 may perform at least some of functions that can be provided by the AP 810. For example, the cellular module 821 may perform at least some of multimedia control functions.

The cellular module 821 may include a Communication Processor (CP). Further, the cellular module 821 may be implemented, for example, with an SoC. Although elements such as the cellular module 821 (e.g., the communication processor), the memory 130, the power management module 895, and the like are illustrated as separate elements with respect to the AP 810 in FIG. 8, the AP 810 may also be implemented such that at least one part (e.g., the cellular module 821) of the aforementioned elements is included.

The AP 810 or the cellular module 821 (e.g., the communication processor) load an instruction or data, which is received from each non-volatile memory connected thereto or at least one of different elements, to a volatile memory and may process the instruction or data. In addition, the AP 810 or the cellular module 821 store data, which is received from at least one of different elements or generated by at least one of different elements, into the non-volatile memory.

Each of the WiFi module 823, the BT module 825, the GPS module 827, and the NFC module 828 may include, for example, a processor for processing data transmitted/received through a corresponding module. Although the cellular module 821, the WiFi module 823, the BT module 825, the GPS module 827, and the NFC module are illustrated in FIG. 8 as separate blocks, according to one embodiment, at least some (e.g., two or more) of the cellular module 821, the WiFi module 823, the BT module 825, the GPS module 827, and the NFC module 828 may be included in one Integrated Chip (IC) or IC package. For example, at least some of processors corresponding to the cellular module 821, the WiFi module 823, the BT module 825, the GPS module 827, and the NFC module 828 (e.g., a communication processor corresponding to the cellular module 821 and a WiFi processor corresponding to the WiFi module 823) may be implemented with an SoC.

The RF module 829 transmits/receives data, for example, transmits/receives an RF signal. The RF module 829 may include, for example, a transceiver, a Power Amp Module (PAM), a frequency filter, a Low Noise Amplifier (LNA), and the like. In addition, the RF module 829 may further include a component for transmitting/receiving a radio wave on a free space in wireless communication, for example, a conductor, a conducting wire, and the like. The cellular module 821, the WiFi module 823, the BT module 825, the GPS module 827, and the NFC module 828 share one RF module 829, according to one embodiment, at least one of the cellular module 821, the WiFi module 823, the BT module 825, the GPS module 827, the NFC module 828 may transmit/receive an RF signal via separate RF modules.

The SIM card 824 may be inserted to a slot formed at a specific location of the electronic device. The SIM card 824 may include unique identification information (e.g., an Integrated Circuit Card IDentifier (ICCID)) or subscriber information (e.g., an International Mobile Subscriber Identity (IMSI)).

The memory 130 includes an internal memory 832 or an external memory 834. The internal memory 832 may include, for example, at least one of a volatile memory (e.g., a Dynamic RAM (DRAM), a Static RAM (SRAM), a Synchronous Dynamic RAM (SDRAM), etc.) or a non-volatile memory (e.g., a One Time Programmable ROM (OTPROM), a Programmable ROM (PROM), an Erasable and Programmable ROM (EPROM), an Electrically Erasable and Programmable ROM (EEPROM), a Mask ROM, a Flash ROM, a NAND flash memory, a NOR flash memory, etc.).

The internal memory 832 may be a Solid State Drive (SSD). The external memory 834 may further include a Compact Flash (CF) or other flash drive, and may further include, for example, Secure Digital (SD), Micro Secure Digital (Micro-SD), Mini Secure digital (Mini-SD), extreme Digital (xD), memory stick, and the like. The external memory 834 may be operatively coupled to the electronic device 801 via various interfaces. The electronic device 801 may further include a storage unit (or a storage medium) such as a hard drive.

The sensor module 840 measures a physical quantity and/or detects an operation state of the electronic device 801, and converts the measured or detected information into an electric signal. The sensor module 840 may include, for example, at least one of a gesture sensor 840A, a gyro sensor 840B, a pressure sensor 840C, a magnetic sensor 840D, an acceleration sensor 840E, a grip sensor 840F, a proximity sensor 840G, a color sensor 840H (e.g., a Red, Green, Blue (RGB) sensor), a bio sensor 840I, a temperature/humidity sensor 840J, an illumination sensor 840K, and an Ultra Violet (UV) sensor 840M. Additionally or alternatively, the sensor module 840 may include, for example, an E-node sensor, an ElectroMyoGraphy (EMG) sensor, an ElectroEncephaloGram (EEG) sensor, an ElectroCardioGram (ECG) sensor, a fingerprint sensor, etc. The sensor module 840 may further include a control circuit for controlling at least one or more sensors included therein.

The input module 850 may include a touch panel 852, a (digital) pen sensor 854, a key 856, or an ultrasonic input device 858. The touch panel 852 recognizes a touch input by using, e.g., at least one of an electrostatic type sensor, a pressure-sensitive type sensor, and an ultrasonic type sensor. The touch panel 852 may further include a control circuit. For the electrostatic type sensor, a physical contact and a proximity recognition are possible. The touch penal 852 may further include a tactile layer. In this case, the touch panel 852 may provide the user with a tactile reaction.

The (digital) pen sensor 854 may be implemented, for example, by using the same or similar method of receiving a touch input of the user or by using an additional sheet for recognition. The key 856 may be, for example, a physical button, an optical key, a keypad, or a touch key. The ultrasonic input device 858 detects a sound wave through a microphone (e.g., a microphone 888) by using a pen which generates an ultrasonic signal, and is a device capable of radio recognition. The electronic device 801 may use the communication module 820 to receive a user input from an external device (e.g., a computer or a server) connected thereto.

The display 150 may include a panel 862, a hologram device 864, or a projector 866. The panel 862 may be, for example, a Liquid-Crystal Display (LCD), an Active-Matrix Organic Light-Emitting Diode (AM-OLED), etc. The panel 862 may be implemented, for example, in a flexible, transparent, or wearable manner. The panel 862 may be constructed as one module with the touch panel 852. The hologram device 864 uses an interference of light to display a stereoscopic image in the air. The projector 866 displays an image by projecting a light beam onto a screen. The screen may be located, for example, inside or outside the electronic device 801. The display 860 may further include a control circuit for controlling the panel 862, the hologram device 864, or the projector 866.

The interface 870 may include, for example, a High-Definition Multimedia Interface (HDMI) 872, a Universal Serial Bus (USB) 874, an optical communication interface 876, and/or a D-subminiature (D-sub) 878. The interface 870 may be included, for example, in the communication interface 160 of FIG. 1. Additionally or alternatively, the interface 870 may include, for example, Mobile High-definition Link (MHL), Secure Digital (SD)/Multi-Media Card (MMC) or Infrared Data Association (IrDA).

The audio codec 880 may bilaterally convert a sound and electric signal. At least some elements of the audio module 808 may be included in, for example, the input/output interface 140 of FIG. 1. The audio codec 880 may convert sound information which is input or output, for example, through a speaker 882, a receiver 884, an earphone 886, the microphone 888, and the like.

The camera module 891 is a device for image and video capturing, and according to one embodiment, may include one or more image sensors (e.g., a front sensor or a rear sensor), a lens, an Image Signal Processor (ISP), or a flash (not shown, e.g., LED or xenon lamp).

The power management module 895 manages power of the electronic device 801, and the power management module 895 may include, for example, a Power Management Integrated Circuit (PMIC), a charger Integrated Circuit (IC), or a battery gauge.

The PMIC may be placed, for example, inside an IC or SoC semiconductor. Charging may be classified into wired charging and wireless charging. The charger IC may charge a battery, and may avoid an over-voltage or over-current flow from a charger. The charger IC may further include a charger IC for at least one of the wired charging and the wireless charging. The wireless charging may be classified, for example, into a magnetic resonance type, a magnetic induction type, and an electromagnetic type. An additional circuit for the wireless charging, for example, a coil loop, a resonant circuit, a rectifier, and the like, may be added.

The battery gauge may measure, for example, a residual quantity of the battery and a voltage, current, and temperature during charging. The battery 896 stores or generates electricity, and may supply power to the electronic device 801 by using the stored or generated electricity. For example, the battery 896 may include a rechargeable battery or a solar battery.

The indicator 897 may indicate a specific state, for example, a booting state, a message state, a charging state, and the like, of the electronic device 801 or a part thereof (e.g., the AP 810). The motor 898 converts an electric signal into a mechanical vibration. The electronic device 801 may include a processing unit (e.g., a GPU) for supporting mobile TV. The processing unit for supporting mobile TV may process media data according to a protocol of, for example, Digital Multimedia Broadcasting (DMB), Digital Video Broadcasting (DVB), media flow, and the like.

Each of the aforementioned elements of the electronic device according to various embodiments of the present disclosure may consist of one or more components, and names thereof may vary depending on a type of electronic device. The electronic device according to various embodiments of the present disclosure may include at least one of the aforementioned elements. Some of the elements may be omitted, or additional other elements may be further included. In addition, some of the elements of the electronic device according to various embodiments of the present disclosure may be combined and constructed as one entity, so as to equally perform functions of corresponding elements before combination.

The term "module" used in various embodiments of the present document may imply a unit including, for example, one of hardware, software, and firmware or a combination of two or more of them. The "module" may be interchangeably used with a term such as a unit, a logical block, a component, a circuit, and the like. The "module" may be a minimum unit of an integrally constituted component or may be a part thereof. The "module" may be a minimum unit for performing one or more functions or may be a part thereof. The "module" may be mechanically or electrically implemented. For example, the "module" of the present disclosure may include at least one of an Application-Specific Integrated Circuit (ASIC) chip, a Field-Programmable Gate Arrays (FPGAs), and a programmable-logic device, to perform certain operations.

According to various embodiments, at least some parts of a device (e.g., modules or functions thereof) or method (e.g., operations) according to various embodiments of the present disclosure may be implemented with an instruction stored in a computer-readable storage media for example. If the instruction is executed by one or more processors (e.g., the processor 810), the one or more processors will perform a function corresponding to the instruction. The computer-readable storage media may be, for example, the memory 830. At least some parts of the programming module may be implemented (e.g., executed), for example, by the processor 810. At least some parts of the programming module may include modules, programs, routines, sets of instructions, processes, and the like, for performing one or more functions.

The computer readable recording medium may be a hardware device configured particularly to store and perform a program instruction (e.g., program module), for example, a hard disk, a magnetic medium such as a floppy disc and a magnetic tape, an optical storage medium such as a Compact Disc-ROM (CD-ROM) or a Digital Versatile Disc (DVD), a magnetic-optic medium such as a floptical disc, a Read Only Memory (ROM), a Random Access Memory (RAM), a flash memory, and the like. An example of the program instruction includes not only a machine language created by a compiler but also a high-level language executable by a computer by using an interpreter or the like. The aforementioned hardware device may be configured to operate as one or more software modules to perform the operation of the present disclosure.

The module or programming module according to various embodiments of the present disclosure may further include at least one or more elements among the aforementioned elements, or may omit some of them, or may further include additional other elements. Operations performed by a module, programming module, or other elements according to various embodiments of the present disclosure may be executed in a sequential, parallel, repetitive, or heuristic manner. In addition, some of the operations may be executed in a different order or may be omitted, or other operations may be added.

While the present disclosure has been shown and described with reference to certain embodiments thereof, it will be understood by those skilled in the art that various changes in form and details may be made therein without departing from the spirit and scope of the disclosure as defined by the appended claims, and equivalents thereof.

What is claimed is:

1. An electronic device comprising:

a housing comprising an interior region and an edge region surrounding the interior region;

a metal bezel disposed on at least a portion of the edge region, wherein at least a portion of the metal bezel is configured to operate in at least one frequency band as a first antenna radiator;

a second antenna radiator disposed in the interior region; and a metal patch disposed at a position, which is spaced apart from the first antenna radiator and the second antenna radiator such that at least a portion of the metal patch is disposed in parallel with at least a portion of the first antenna radiator and the second antenna radiator, respectively.

2. The electronic device of claim 1, wherein the metal patch operates as a parasitic antenna radiator for tuning one of a radiation pattern and a peak gain of the antenna radiator.

3. The electronic device of claim 1, wherein each characteristic of the first antenna radiator and the second antenna radiator is determined by at least one of a distance that the antenna radiators are spaced apart from the metal patch, an area of overlap of the first antenna radiator and the second antenna radiator, the metal patch, the position of the metal patch, and a shape of the metal patch.

4. The electronic device of claim 1, wherein the metal patch is separated from the first antenna radiator and the second antenna radiator by a first spaced distance and a second distance, respectively.

5. The electronic device of claim 4, wherein the metal patch is electrically connected with the first antenna radiator and the second antenna radiator by mutual direct physical contact.

6. The electronic device of claim 1, wherein the metal bezel is segmented by a segmented part formed of a non-metallic material to include a first antenna unit and a second antenna unit, and wherein the metal patch has a pre-designated length along the metal bezel such that the first antenna unit and the second antenna unit are parallel with at least the portion of the metal patch, respectively.

7. The electronic device of claim 1, wherein the metal patch comprises at least one of a thin-board type metal plate attached to adjacent parts of the electronic device, a Flexible Printed Circuit (FPC) comprising a radiation pattern, a conductive tape, and a conductive paint painting the adjacent parts in a radiation pattern.

8. The electronic device of claim 1, wherein at least a partial region of the metal patch overlaps the second antenna radiator in a vertical direction.

9. The electronic device of claim 1, wherein at least a partial region of the metal patch is flush with the first antenna radiator in a horizontal direction.

10. The electronic device of claim 1, wherein the metal patch is arranged in a cover member of the electronic device.

11. The electronic device of claim 10, wherein the metal patch is attached to one of an inner surface and an outer surface of the cover member.

12. The electronic device of claim 11, wherein the metal patch is used as a decoration if the metal patch is attached to the outer surface of the cover member.

13. The electronic device of claim 10, wherein, if the cover member is formed of a synthetic resin material, the metal patch is positioned on at least one of an inner part of the cover member, an inner surface of the cover member, and an outer surface of the cover member, by insert injection.

14. The electronic device of claim 10, wherein the cover member comprises at least one of a battery cover of the electronic device, an external housing of the electronic device, and an inner housing of the electronic device.

15. An electronic device comprising:

a housing comprising a first plate, a second plate facing away from the first plate, and a side plate connected to edges of the first plate and the second plate respectively;

a metal bezel disposed on at least a portion of the side plate, wherein at least a portion of the metal bezel is configured to operate in at least one frequency band as a first antenna radiator;

a second antenna radiator disposed between the first plate and the second plate; and a metal patch disposed on the first plate at a position, which is spaced apart from the first antenna radiator and the second antenna radiator such that at least a portion of the metal patch is disposed in parallel with at least a portion of the first antenna radiator and overlaps the second antenna radiator in a vertical direction, wherein the metal patch is electrically coupled to the first antenna radiator and the second antenna radiator such that the metal patch operates as a parasitic resonator.

* * * * *